US009955838B2

(12) United States Patent
Millington et al.

(10) Patent No.: US 9,955,838 B2
(45) Date of Patent: May 1, 2018

(54) HANDLE ASSEMBLY FOR A VACUUM CLEANER

(71) Applicant: Dyson Technology Limited, Wiltshire (GB)

(72) Inventors: David Alan Millington, Swindon (GB); Charles Geoffrey Box, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 52 days.

(21) Appl. No.: 15/264,353

(22) Filed: Sep. 13, 2016

(65) Prior Publication Data

US 2017/0071433 A1 Mar. 16, 2017

(30) Foreign Application Priority Data

Sep. 14, 2015 (GB) ..... 1516182.1

(51) Int. Cl.
*A47L 9/32* (2006.01)
*A47L 9/24* (2006.01)
*A47L 5/36* (2006.01)

(52) U.S. Cl.
CPC ..... *A47L 9/327* (2013.01); *A47L 5/36* (2013.01); *A47L 9/24* (2013.01)

(58) Field of Classification Search
CPC ..... A47L 5/36; A47L 9/24; A47L 9/327
See application file for complete search history.

(56) References Cited

U.S. PATENT DOCUMENTS

2002/0101075 A1* 8/2002 Park ..... A47L 9/242 285/7
2002/0189046 A1* 12/2002 Nighy ..... A47L 9/242 15/327.1
2004/0163202 A1* 8/2004 Yoshimi ..... A47L 5/32 15/331
2004/0261211 A1* 12/2004 Overvaag ..... A47L 9/327 15/327.1
2011/0214250 A1* 9/2011 McLeod ..... A47L 9/0072 15/383
2014/0237755 A1* 8/2014 Conrad ..... A47L 5/225 15/329
2014/0237767 A1* 8/2014 Conrad ..... A47L 9/2857 15/353

(Continued)

FOREIGN PATENT DOCUMENTS

CA 2460256 A1 * 12/2004 ..... A47L 9/327
DE 202016008041 U1 * 5/2017 ..... A47L 5/362
EP 2 542 135 1/2013

(Continued)

OTHER PUBLICATIONS

Search Report dated Feb. 26, 2016, directed to GB Application No. 1516182.1, 1 page.

(Continued)

*Primary Examiner* — Marc Carlson
(74) *Attorney, Agent, or Firm* — Morrison & Foerster LLP

(57) ABSTRACT

A handle assembly for a vacuum cleaner that includes a handle attached to a duct assembly. The duct assembly includes a first duct and a second duct. The first duct pivots relative to the second duct about a pivot axis, and the first duct and the second duct rotate collectively relative to the handle about a rotation axis. The rotation axis is then orthogonal to the pivot axis.

20 Claims, 6 Drawing Sheets

(56) References Cited

U.S. PATENT DOCUMENTS

2017/0071432 A1* 3/2017 Millington ..... A47L 5/225

FOREIGN PATENT DOCUMENTS

| | | | | |
|---|---|---|---|---|
| GB | 2478387 | | | 9/2011 |
| JP | 5-84197 | | | 4/1993 |
| JP | 5-161580 | | | 6/1993 |
| JP | 05161580 | A | * | 6/1993 |
| JP | 5-56049 | | | 7/1993 |
| JP | H0556049 | U | * | 7/1993 |
| JP | 2000300484 | A | * | 10/2000 |
| JP | 2001-275906 | | | 10/2001 |
| JP | 2002-233482 | | | 8/2002 |
| JP | 2004-166889 | | | 6/2004 |
| JP | 2004-261587 | | | 9/2004 |
| JP | 2006-314569 | | | 11/2006 |
| JP | 2006-326093 | | | 12/2006 |
| JP | 2006-326186 | | | 12/2006 |
| JP | 2006-334098 | | | 12/2006 |
| JP | 2006-334157 | | | 12/2006 |
| JP | 2006-346115 | | | 12/2006 |
| JP | 2007-44430 | | | 2/2007 |
| JP | 2007-54303 | | | 3/2007 |
| JP | 2007-89749 | | | 4/2007 |
| JP | 2007-135651 | | | 6/2007 |
| KR | 2000-0009647 | | | 6/2000 |
| KR | 10-0774509 | | | 11/2007 |
| KR | 10-0962731 | | | 6/2010 |
| WO | WO-99/35954 | | | 7/1999 |
| WO | WO-2011/107768 | | | 9/2011 |

OTHER PUBLICATIONS

International Search Report and Written Opinion dated Dec. 8, 2016, directed to International Application No. PCT/GB2016/052747; 9 pages.

* cited by examiner

HANDLE ASSEMBLY FOR A VACUUM CLEANER

REFERENCE TO RELATED APPLICATION

This application claims priority of United Kingdom Application No. 1516182.1, filed Sep. 14, 2015, the entire contents of which are incorporated herein by reference.

FIELD OF THE INVENTION

The present invention relates to a handle assembly for a vacuum cleaner.

BACKGROUND OF THE INVENTION

The handle assembly of a vacuum cleaner may comprise a duct through which dirt-laden air is carried. One end of the duct may be attached to a hose, which in turn is attached to a main body of the vacuum cleaner. The other end of the duct may be attached to an elongate tube, which in turn is attached to a cleaner head. During use, the handle assembly is used to maneuver the cleaner head over a surface to be cleaned. Unfortunately, the hose often restricts or impedes movement of the handle assembly, thus making it difficult to maneuver the cleaner head.

SUMMARY OF THE INVENTION

The present invention provides a handle assembly for a vacuum cleaner, the handle assembly comprising a handle attached to a duct assembly, wherein the duct assembly comprises a first duct and a second duct, the first duct pivots relative to the second duct about a pivot axis, the first duct and the second duct rotate collectively relative to the handle about a rotation axis, and the rotation axis is orthogonal to the pivot axis.

One end of the duct assembly may be attached to a hose of the vacuum cleaner, and the other end may be attached to a cleaner head, accessory tool or other attachment, perhaps via an elongate tube. The handle assembly may then be used to maneuver the attachment over a cleaning surface. As the attachment is maneuvered, the handle assembly provides two degrees of freedom in the movement of the hose relative to the handle. In particular, the hose is free to pivot relative to the handle about the pivot axis, and the hose is free to rotate relative to the handle about the rotation axis. By providing two degrees of freedom, restriction in the movement of the handle by the hose is significantly reduced.

The duct assembly may comprise a third duct to which the handle is fixedly attached. The second duct may then be rotatably attached to the third duct. This then has the advantage that the handle may be used to better control the orientation of an attachment without undue interference from the hose. For example, by rotating the handle about the rotation axis, the orientation of an attachment attached to the third duct may be changed. As the handle rotates, the weight of a hose attached to the first duct will cause the first and second ducts to rotate relative to the handle about the rotation axis. The net result is that the first and second ducts remain stationary as the handle rotates, and thus the hose does not interfere with or impede the movement of the handle.

The handle may be rotatably attached to second duct for rotation about the rotation axis. Where the duct assembly comprises a third duct, the handle may be fixedly attached at one end to the third duct and rotatably attached at an opposite end to the second duct. This then has the advantage that the weight of a hose attached to the first duct is better supported by the handle assembly and thus the hose is able to rotate more freely relative to the handle.

The first duct may pivot relative to the second duct through an angle of at least 90 degrees. Additionally or alternatively, the first duct and the second duct may rotate relative to the handle through an angle of at least 90 degrees. A hose attached to the duct assembly is then free to pivot and/or rotate relative to the handle through an angle of at least 90 degrees. This represents a relatively large range of movement over which the handle may be used to maneuver an attachment without undue interference from the hose.

The first duct and the second duct may each comprise an arcuate section that arcs about the pivot axis, and pivoting the first duct relative to the second duct may cause the arcuate section of one of the ducts to move in and out of the arcuate section of the other of the ducts. By having two arcuate sections that arc about the pivot axis, each section is able to subtend a relatively large angle. Consequently, as the first duct pivots relative to the second duct and one of the arcuate sections moves in and out of the other arcuate section, a relatively large degree of pivot movement may be achieved. In arcing about the pivot axis, the two arcuate sections collectively define a segment of a torus that is centered on the pivot axis. As the first duct pivots relative to the second duct and one of the arcuate sections moves in and out of the other arcuate section, the size of the torus segment increases and decreases.

A first end of the duct assembly may extend along a first axis, and a second opposite end of the duct assembly may extend along a second axis. The first duct may then be free to pivot to a position in which the first axis is parallel to the second axis. Consequently, when a hose is attached to the first end and an elongate tube is attached to the second end of the duct assembly, the hose is free to pivot to a position in which the hose extends alongside the elongate tube. This then has the advantage of providing a relative compact arrangement when the handle assembly is not in use.

The pivot axis may be located below the handle, and the second duct may arc upwardly into the space between the handle and the pivot axis. By arcing upwardly into the space beneath the handle, a larger of range of pivot movement may be achieved between the first and second ducts without increasing excessively the height of the handle assembly.

The second duct may be a double-walled duct comprising an inner tube and an outer tube, and pivoting the first duct relative to the second duct may cause the first duct to move between the inner tube and the outer tube. Consequently, when the second duct is located upstream of the first duct, air flowing through the duct assembly moves from the smaller diameter inner tube to the larger diameter first duct. This then has the advantage that the end of the first duct does not present a shoulder to the oncoming flow of air, which would otherwise increase turbulence and thus flow losses and noise. By providing an outer tube in addition to an inner tube, the handle may be attached to the second duct without inhibiting or otherwise restricting the pivoting movement of the first duct.

The present invention also provides a vacuum cleaner comprising a hose and a handle assembly as described in any one of the preceding paragraphs, wherein the hose is attached to one end of the duct assembly and moves relative to the handle as the first duct pivots relative to the second duct and as the first duct and the second duct rotate collectively relative to the handle. The vacuum cleaner may additionally comprise an attachment, such as an elongate tube, a cleaner head or an accessory tool, which is attached to the opposite end of the duct assembly.

BRIEF DESCRIPTION OF THE DRAWINGS

In order that the present invention may be more readily understood, embodiments of the invention will now be described, by way of example, with reference to the accompanying drawings in which.

DETAILED DESCRIPTION OF THE INVENTION

Figure 1:
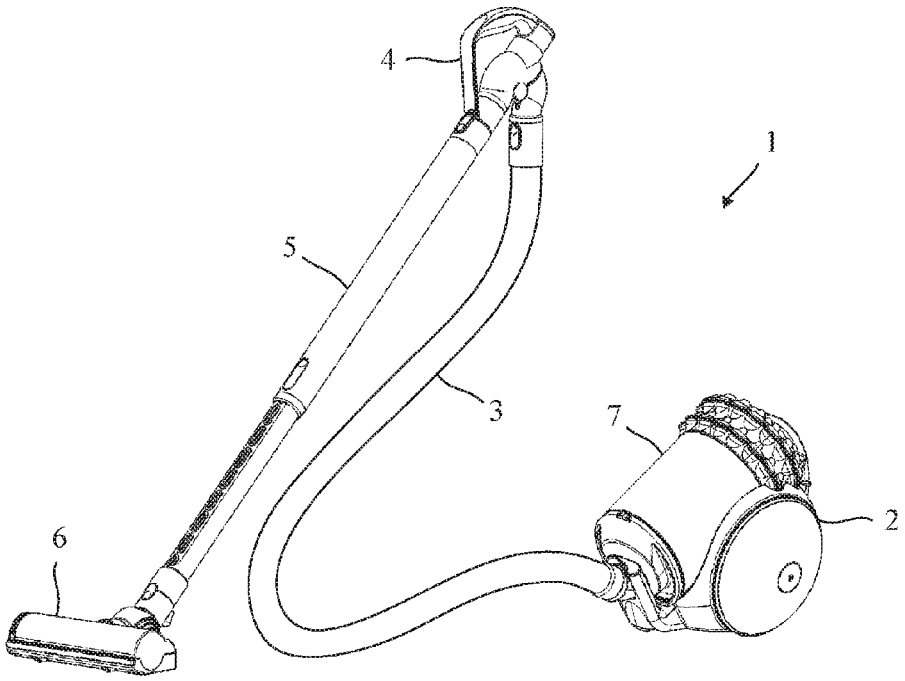
FIG. 1 shows a vacuum cleaner comprising a handle assembly in accordance with the present invention.

The vacuum cleaner 1 of FIG. 1 comprises a main body 2, a hose 3, a handle assembly 4, an elongate tube 5, and a cleaner head 6. The main body 2 comprises a dirt separator 7 and a vacuum motor (not shown). The hose 3 is attached at one end to the main body 2 and at an opposite end to the handle assembly 4. The elongate tube 5 is attached at one end to the handle assembly 4 and at an opposite end to the cleaner head 6. During use, the vacuum motor generates suction that causes dirt-laden air to be drawn in through an opening in the cleaner head 6. From the cleaner head 6, the dirt-laden air is carried to the dirt separator 7 via the elongate tube 5, the handle assembly 4 and the hose 3. The handle assembly 4 is then used to maneuver the cleaner head 6 over the cleaning surface.

Turning now to FIGS. 2 to 8, the handle assembly 4 comprises a handle 10 attached to a duct assembly 11. The hose 3 of the vacuum cleaner is then removably attached to a first end of the duct assembly 11, and the elongate tube 5 is removably attached to a second opposite end of the duct assembly 11.

The duct assembly 11 comprises a first duct 12, a second duct 13, and a third duct 14. The first duct 12 is pivotally attached to the second duct 13, and the second duct 13 is rotatably attached to the third duct 14. The first duct 12 pivots relative to the second duct 13 about a pivot axis 15, and the second duct 13 rotates relative to the third duct 14 about a rotational axis 16 that is orthogonal to the pivot axis 15.

The first duct 12 is pivotally attached to the second duct 13 by means of a pin joint 17 and comprises a straight section 20 and an arcuate section 21. The straight section 20 is configured for attachment to the hose 3, and the arcuate section 21 bends or arcs around the pivot axis 15. The arcuate section 21 describes a circular arc that is centered on the pivot axis 15 and subtends a central angle of around 125 degrees.

The second duct 13 is a double-walled duct comprising an inner tube 28 and an outer tube 29. The two tubes 28,29 are attached such that the tubes 28,29 move together as one. Like that of the first duct 12, the second duct 13 comprises a straight section 30 and an arcuate section 31. The straight section 30 is relatively short and provides the means by which the second duct 13 is rotatably attached to the third duct 14. In particular, the outer tube 29 is slightly longer than the inner tube 28 and comprises an annular groove formed around the inner surface of that part which extends beyond the inner tube 28. An end of the third duct 14 is received within the outer tube 29 and comprises an annular groove formed around its outer surface. A snap ring 34 is then seated within the two grooves so as to permit relative rotation but prevent relative separation of the second duct 13 and the third duct 14. The arcuate section 31 of the second duct 13, like that of the first duct 12, bends or arcs around the pivot axis 15. The arcuate section 31 describes a circular arc that is centered on the pivot axis 15 and subtends a central angle of around 125 degrees. Pivoting the first duct 12 relative to the second duct 13 causes the arcuate section 21 of the first duct 12 to move in and out of the arcuate section 31 of the second duct 13. The diameter of the first duct 12 is greater than that of the inner tube 28 but smaller than that of the outer tube 29. Consequently, as the first duct 12 moves in and out of the second duct 13, the first duct 12 moves between the inner tube 28 and the outer tube 29.

The third duct 13 is generally straight and is configured for attachment to the elongate tube 5.

In order to minimize leakages between ducts, a lip seal 35 is provided at an end of the first duct 12 and a further lip seal 36 is provided at the end of the third duct 14. Both lip seals 35,36 contact and form a seal with the outer tube 29 of the second duct 13.

The handle 10 is generally shaped as an inverted 'v'. One end of the handle 10 is fixedly attached to the third duct 14, and the opposite end of the handle 10 is rotatably attached to the second duct 13. Rotatable attachment is achieved in a similar manner to that between the second duct 13 and the third duct 14. In particular, an end of the handle 10 is shaped as a collar 40 and comprises an annular groove formed around its inner surface. A further collar 41 having a slightly smaller diameter is secured to the outer tube 29 of the second duct 13 and comprises an annular groove formed around its outer surface. A snap ring 42 is then seated within the two grooves so as to permit relative rotation but prevent relative separation of the handle 10 and the second duct 13. The second duct 13 rotates relative to the handle 10 about the same rotation axis 16. Consequently, the second duct 13 swings beneath the handle 10 as if connected to the handle 10 by a hinge.

Figure 3:
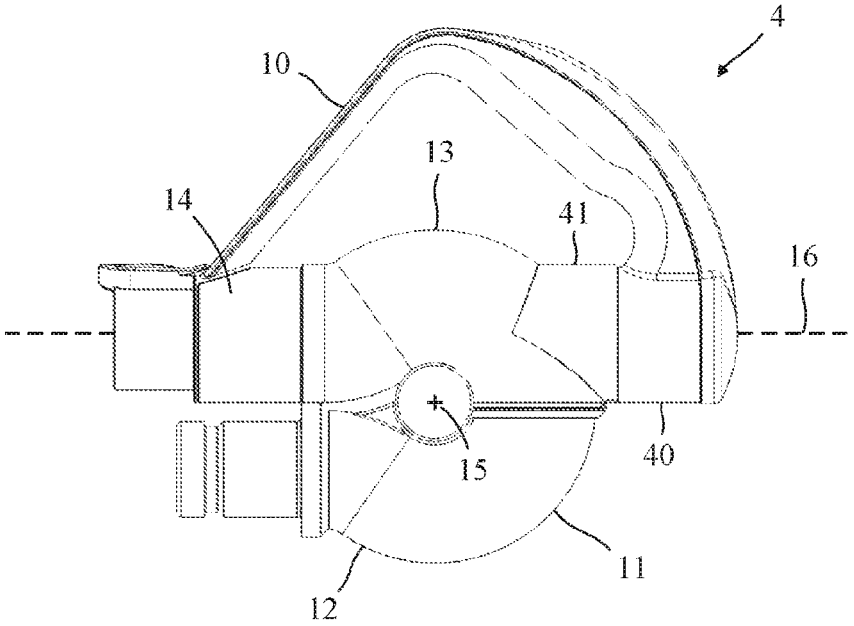
FIG. 3 is side view of the handle assembly in which a duct forming part of the handle assembly is placed in an extended position.
Figure 4:
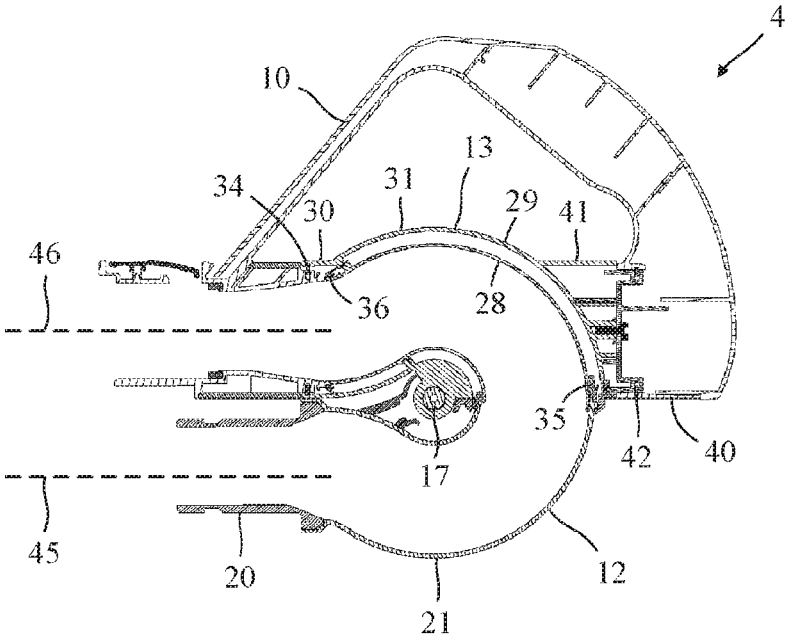
FIG. 4 is a sectional slice through the handle assembly of FIG. 3.
Figure 5:
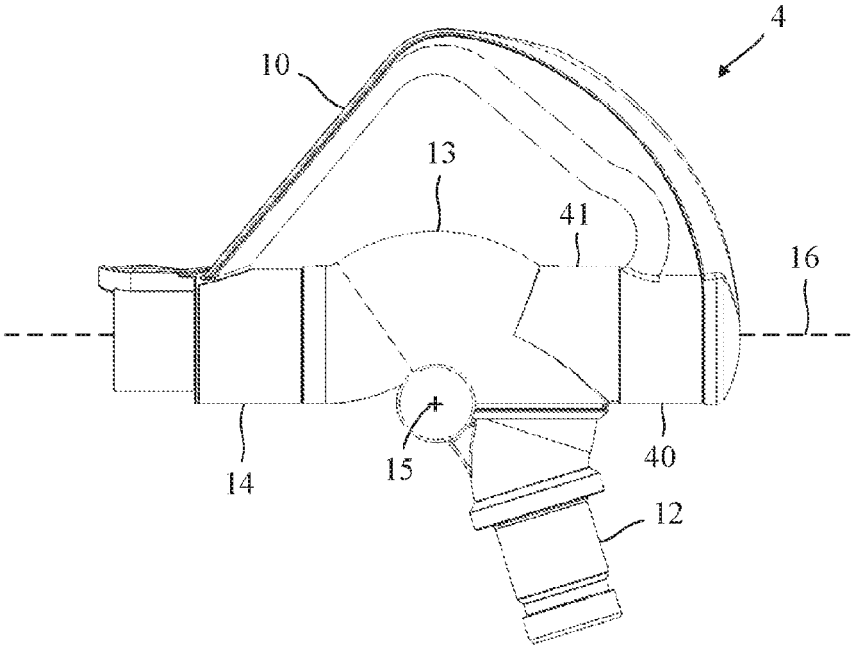
FIG. 5 is side view of the handle assembly in which the duct is placed in a retracted position.
Figure 6:
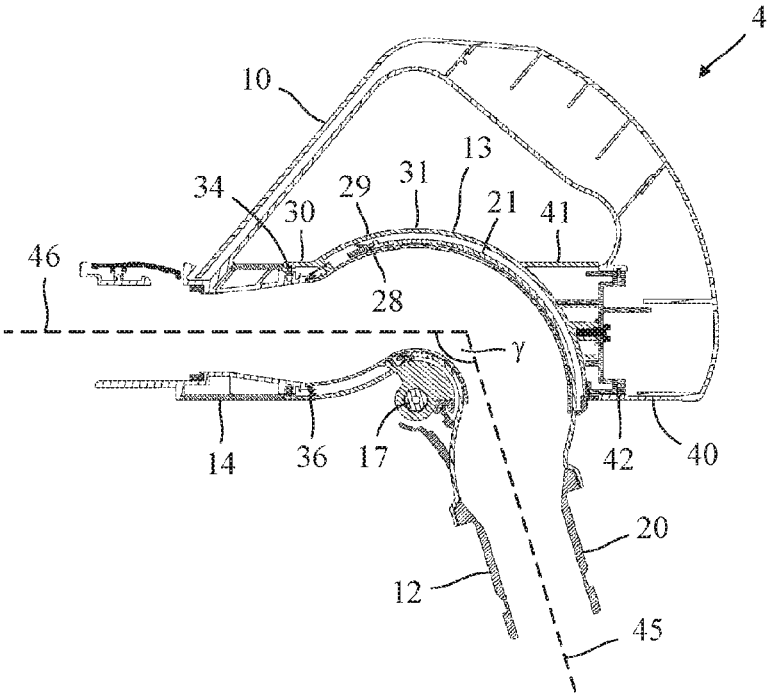
FIG. 6 is a sectional slice through the handle assembly of FIG. 5.

The first duct 12 pivots relative to the second duct 13 between an extended position and a retracted position. FIGS. 3 and 4 illustrate the handle assembly 4 with the first duct 12 in the extended position, and FIGS. 5 and 6 illustrate the handle assembly 4 with the first duct 12 in the retracted position. The first duct 12 pivots through an angle of about 105 degrees when moving between the extended position and the retracted position. Although the arcuate sections 21,31 of the first and second ducts 12,13 each subtend a central angle of 125 degrees, the attachment of the inner tube 28 to the outer tube 29 and the lip seal 35 provided at the end of the first duct 12 restrict the movement of the first duct 12 to about 105 degrees.

Figure 7:
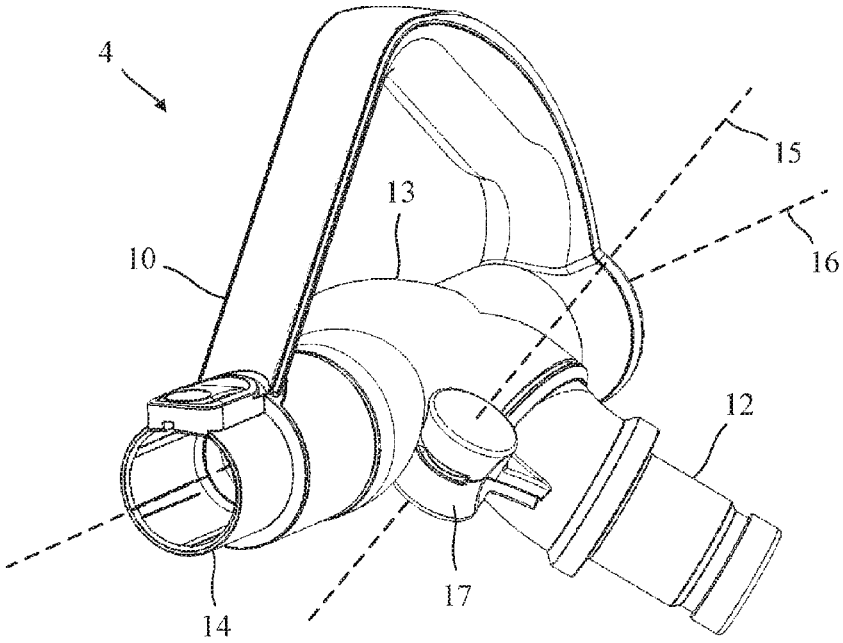
FIG. 7 is a perspective view of the handle assembly in which ducts forming part of the handle assembly are rotated in a first direction.
Figure 8:
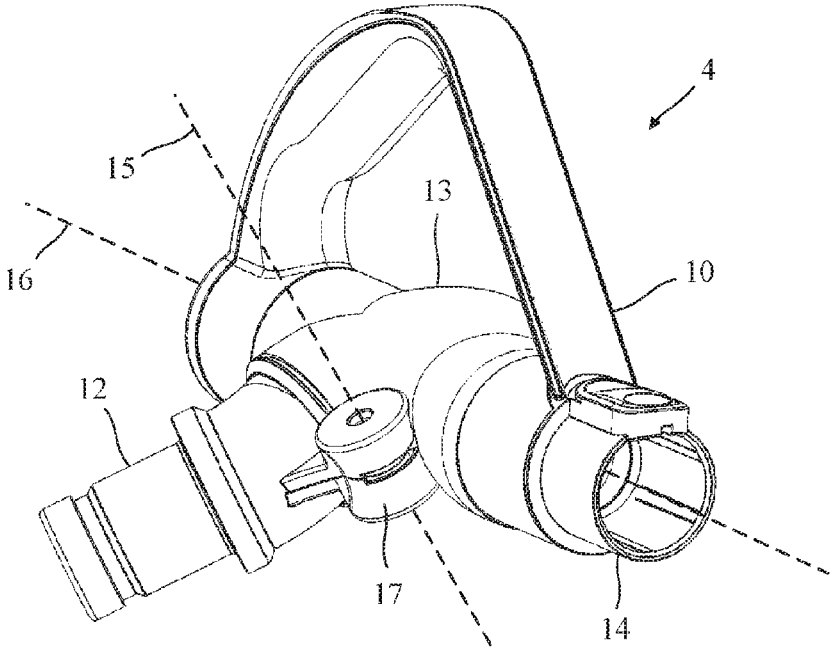
FIG. 8 is a perspective view of the handle assembly in which the ducts are rotated in a second direction.

The first duct 12 and the second duct 13 rotate collectively relative to the handle 10. FIG. 7 illustrates the handle assembly 4 with the first and second ducts 12,13 rotated in a first direction, and FIG. 8 illustrates the handle assembly 4 with the first and second ducts 12,13 rotated in a second opposite direction. The degree of rotation of the ducts 12,13 is limited only by the handle 10, and in particular by the first duct 12 contacting the handle 10. Consequently, the first and second ducts 12,13 are free to rotate through about 280 degrees.

The first end of the duct assembly 11 (i.e. that end which attaches to the hose 3) may be said to extend longitudinally along a first axis or a hose axis 45, and the second end of the duct assembly 11 (i.e. that end which attaches to the elongate tube 5) may be said to extend longitudinally along a second axis or a tube axis 46. For the purposes of the present discussion, the term 'hose angle' will be used when referring to the included angle γ between the hose axis 45 and the tube axis 46. When the first duct 12 is in the extended position, as shown in FIGS. 3 and 4, the hose axis 45 is parallel to the tube axis 46 and thus the hose angle γ is 0 degrees. When the first duct 12 is in the retracted position, as shown in FIGS. 5 and 6, the hose angle γ is about 105 degrees.

Figure 9:
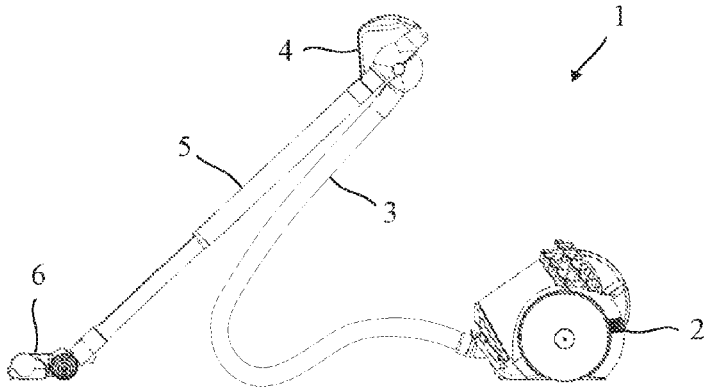
FIG. 9 is a side view of the vacuum cleaner of FIG. 1 in a first use position.
Figure 10:
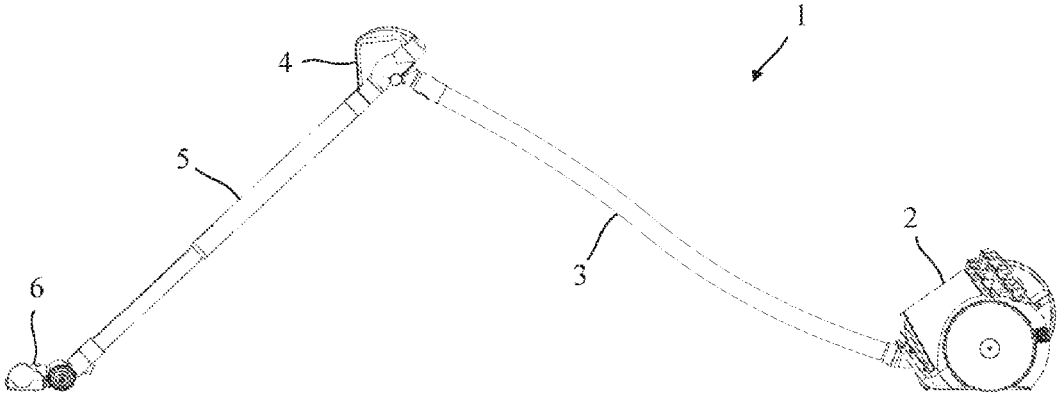
FIG. 10 is a side view of the vacuum cleaner of FIG. 1 in a second use position.

During use of the vacuum cleaner 1, the handle assembly 4 is typically held such that the elongate tube 5 forms an included angle of about 45 degrees with the cleaning surface. Owing to the weight of the hose 3, the hose 3 tends to hang vertically downwards from the handle assembly 4. As the cleaner head 6 is maneuvered forwards and backwards over the cleaning surface, the angle between the elongate tube 5 and the cleaning surface remains roughly the same. However, the separation distance between the handle assembly 4 and the main body 2 increases and decreases as the cleaner head 6 is maneuvered forwards and backwards respectively. Although the hose 3 provides a degree of bending flexibility, there is little flexibility in the overall length of the hose 3. Consequently, as the cleaner head 6 is maneuvered forwards and backwards, the shape of the hose 3 must change in order to accommodate the change in the separation distance between the handle assembly 4 and the main body 2. As can be seen in FIGS. 9 and 10, as the shape of the hose 3 changes, the hose angle .gamma. of the handle assembly 4 changes. In particular, as the cleaner head 7 is moved forwards and backwards over the cleaning surface, the hose angle .gamma. increases and decreases respectively.

With a conventional handle assembly having a fixed hose angle, the hose can often impede movement of the handle assembly. Additionally, the hose often buckles outwardly to one side of the handle assembly as the handle assembly is moved backwards and the separation distance between the handle assembly and the main body decreases. This buckle in the hose then places a twisting torque on the handle assembly, which a user must then oppose. All of this increases the strain on the wrist of the user.

With the handle assembly 4 described herein, the change in the shape of the hose 3 as the cleaner head 6 is maneuvered forwards and backwards is accommodated through changes in the hose angle .gamma.. As a result, the user experiences less resistance from the hose 3 as the cleaner head 6 is maneuvered forwards and backwards. The handle assembly 4 provides a relatively large degree of movement in the hose 3. In particular, the hose angle .gamma. is free to vary from 0 degrees to 105 degrees. As a result, the user experiences significantly less resistance from the hose 3 over a relatively large range of movement of the cleaner head 6. In particular, little resistance may be felt as the cleaner head 6 is maneuvered forwards and backwards over the range illustrated in FIGS. 9 and 10. The relatively large degree of movement in the hose 3 is made possible through the provision of the arcuate sections 21,31 in the first and second ducts 12,13. By having arcuate sections 21,31 that arc around the pivot axis 15, each of the arcuate sections 21,31 is free to subtend a relatively large angle, which in turn defines the permissible degree of pivot movement of the hose 3.

In addition to maneuvering the cleaner head 6 forwards and backwards, the handle assembly 4 may be used to steer the cleaner head 6 to the left and right. This is achieved by rotating the handle 10 about the tube axis 46. The handle 10 is fixedly attached to the third duct 13, which in turn is attached to the elongate tube 5. Rotating the handle 10 to the left or right therefore causes the elongate tube 5 to rotate about the tube axis 46, which in turn causes the cleaner head 6 to rotate to the left or right. As the handle 10 rotates about the tube axis 46, the weight of the hose 3 causes the first and second ducts 12,13 to rotate relative to the handle 10 about the rotation axis 16, which is coincident with the tube axis 46. The net result is that the first and second ducts 12,13 remain stationary as the handle 10 rotates to the left and right. This then has the benefit that the hose 3 does not interfere with or impede the handle assembly 4 when steering the cleaner head 6. In contrast, if there was no relative rotation between the handle 10 and the second duct 13, rotating the handle 10 to the left and right would cause the hose 3 to be lifted upwards. Owing to the weight of the hose 3, this would place a strain on the wrist of the user, thereby making steering difficult and tiresome.

Figure 2:
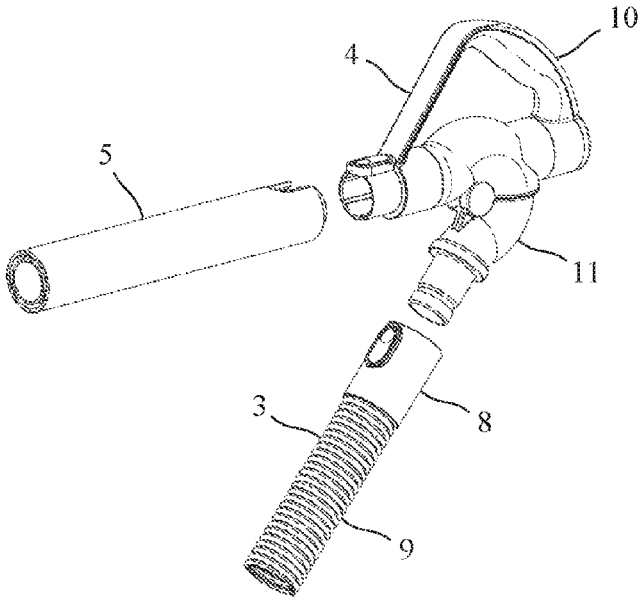
FIG. 2 is an exploded view of the handle assembly, hose and elongate tube of the vacuum cleaner.

The handle assembly 4 provides two degrees of freedom in the movement of the hose 3 relative to the handle 10. First, the hose 3 is free to pivot relative to the handle 10 about the pivot axis 15. Second, the hose 3 is free to rotate relative to the handle 10 about the rotation axis 16. By providing these two degrees of freedom, restriction in the movement of the handle 10 by the hose 3 is reduced and thus maneuvering the cleaner head 6 is made easier. As will now be explained, a further degree of freedom in the relative movement of the hose 3 may be provided. As illustrated in FIG. 2, the hose 3 comprises a cuff 8 attached to one end of a flexible hose 9. The cuff 8 is then used to attach the flexible hose 9 to the handle assembly 4. The cuff 8 may be attached to the flexible hose 9 in a manner that provides relative rotation about the hose axis 45. Alternatively, the cuff 8 may be fixedly attached to the flexible hose 9, and the straight section 20 of the first duct 12 may be configured so as to permit relative rotation of the cuff 8 about the hose axis 45. In both instances, the flexible hose 9 is free to rotate relative to the handle 10 about the hose axis 45. By providing this additional degree of freedom in the movement of the hose 3, restriction in the movement of the handle 10 by the hose 3 may be further reduced.

The arcuate section 31 of the second duct 13 arcs upwardly into the space below the handle 10. By using this otherwise unutilized space beneath the handle 10, the arcuate sections 21,31 of the duct assembly 11 are able to subtend relatively large angles, and thus provide a relatively large degree of movement between the extended and retracted positions, without increasing excessively the height of the handle assembly 4. Additionally, by first arcing upwards, a similar degree of bending may be achieved at the transition of the straight section 20,30 and arcuate section 21,31 for both ducts 12,13. By contrast, if the second duct 13 did not arc upwards then a sharper bend would be required at the transition between the straight and arcuate sections 20,21 of the first duct 12. As a result, air flowing through the duct assembly 11 would experience greater turbulence at the transition in the first duct 12, thereby leading to increased flow losses and noise.

A relatively large degree of movement in the hose 3 is made possible through the provision of the arcuate sections 21,31 in the first and second ducts 12,13. Conceivably, a similar range of motion might be achieved by removing the arcuate sections 21,31 and having a stretch hose that extends between the straight sections 20,30 of the first and second ducts 12,13. However, the use of a stretch hose has several disadvantages. A stretch hose has a corrugated inner surface. As a result, air flowing through the stretch hose experiences greater turbulence than that flowing through a duct having a smooth inner surface. There are therefore greater flow losses and increased noise associated with the stretch hose. Additionally, a stretch hose is more expensive than a rigid duct. The handle assembly 4 described herein provides a relatively large degree of movement of the hose 3 relative to the handle 10 in a way that reduces flow losses, noise and cost.

In the embodiment described above, the second duct 13 is a double-walled duct that comprises an inner tube 28 and an outer tube 29. Since the first duct 12 and the third duct 14 each form a seal with the outer tube 29, the inner tube 28 could conceivably be omitted. However, as will now be explained, there are advantages in having the inner tube 28. The second duct 13 is located upstream of the first duct 12, which is to say that air flowing through the duct assembly 11 first passes through the second duct 13 before passing through the first duct 12. Consequently, if the inner tube 28 were removed, air would flow from the larger diameter second duct 13 to the smaller diameter first duct 12. The end of the first duct 12 would then present a shoulder to the oncoming flow of air. As a result, the seal 35 at the end of the first duct 12 may become damaged by dirt and debris carried by the air flow, resulting in poorer suction at the cleaner head 6. Additionally, dirt carried by the air flow may collect at the shoulder and become inadvertently trapped between the first duct 12 and the second duct 13 as the first duct 12 moves in and out of the second duct 13. Finally, air flowing through the duct assembly 11 is likely to experience increased turbulence, resulting in increased flow losses and noise. In spite of these disadvantages, the inner tube 28 may nevertheless be omitted. Conversely, the inner tube 28 may be retained and the outer tube 29 may be omitted. In this instance, the first duct 12 and the third duct 14 would each form a seal with the inner tube 28. The advantage of this arrangement is that air would flow from the smaller diameter second duct 13 to the larger diameter first duct 12. The end of the first duct 12 would not therefore present a shoulder to the oncoming flow of air. However, a disadvantage with this arrangement is that the handle 10 cannot then be rotatably attached to the second duct 13, otherwise pivoting of the first duct 12 relative to the second duct 13 will be inhibited. As explained below, whilst it is possible for the handle 10 to be attached to the third duct 14 only, there are advantages in additionally attaching the handle 10 to the second duct 13. The second duct 13 may therefore be a single-walled duct or a double-walled duct. Where the second duct 13 is a single-walled duct, the first duct 12 may move in and out of the second duct 13 as the first duct 12 pivots about the pivot axis 15. Alternatively, the second duct 13 may move in and out of the first duct 12 as the first duct 12 pivots about the pivot axis 15. Where the second duct 13 is a double-walled duct, the first duct 12 moves in and out of the outer tube 29, and the inner tube 28 moves in and out of the first duct 12. Accordingly, in a more general sense, pivoting the first duct 12 relative to the second duct 13 may be said to cause the arcuate section 21,31 of one of the ducts 12,13 to move in and out of the arcuate section 21,31 of the other of the ducts 12,13.

The second duct 13 is rotatably attached to both the third duct 14 and the handle 10. This then has the advantage that the weight of the hose 3 is better supported by the handle assembly 4 and thus the hose 3 is able to rotate more freely relative to the handle 10. Conceivably, the rotatable attachment with the handle 10 may be omitted. Rotation of the hose 3 relative to the handle 10 would then continue by virtue of the rotatable attachment of the second duct 13 with the third duct 14, to which the handle 10 is fixedly attached. However, the disadvantage of this arrangement is that the weight of the hose 3 would then be supported solely by the rotation joint between the second and third ducts 13,14. As a result, rotation of the hose 3 relative to the handle 10 may be less smooth.

Conceivably, rotation of the hose 3 relative to the handle 10 may be omitted altogether from the handle assembly 4. That is to say that rotation of the second duct 13 relative to the third duct 14 and the handle 10 may be omitted. In this instance, there would be no need for a third duct 14 that is separate from and moves relative to the second duct 13. The third duct 14 would then form part of the second duct 13, the elongate tube 5 would attach to the second duct 13, and the handle 10 would be fixedly attached at one or both ends to the second duct 13. As noted above, rotation of the hose 3 relative to the handle 10 has particular advantages when steering the cleaner head 6. In particular, the hose 3 is free to swing beneath the handle 10 as the handle 10 is rotated to the left and right. Nevertheless, the pivoting movement provided by the first and second ducts 12,13 has particular advantages, irrespective of any rotation of the hose 3 relative to the handle 10. In particular, the provision of two arcuate sections21,31 that arc about the pivot axis 15 provide a relatively large degree of pivoting movement of the hose 3 relative to the handle 10. Consequently, when maneuvering the cleaner head 6 forwards and backwards over the cleaning surface, as illustrated in FIGS. 9 and 10, a user experiences significantly less resistance from the hose 3. Additionally, as explained below and illustrated in FIGS. 11 and 12, the two arcuate sections 21,31 enable a relatively compact arrangement to be achieved when the vacuum cleaner 1,50 is not in use.

In the embodiment illustrated in the Figures, the handle 10 is attached at both ends to the duct assembly 11. However, as noted in the preceding two paragraphs, the handle 10 may be attached at one end only to the duct assembly 11. For example, the handle 10 may be attached solely to the third duct 14, and rotation of the hose 3 relative to the handle 10 may be achieved by virtue of the rotatable attachment of the second duct 13 with the third duct 14. Alternatively, where rotation of the hose 3 relative to the handle 10 is not required, the handle 10 may be fixedly attached at one end only to the second duct 13. Moreover, whilst the handle 10 of the embodiment illustrated in the Figures is v-shaped, alternative shapes are possible, particular when the handle 10 is attached at one end only to the duct assembly 11.

Figure 11:
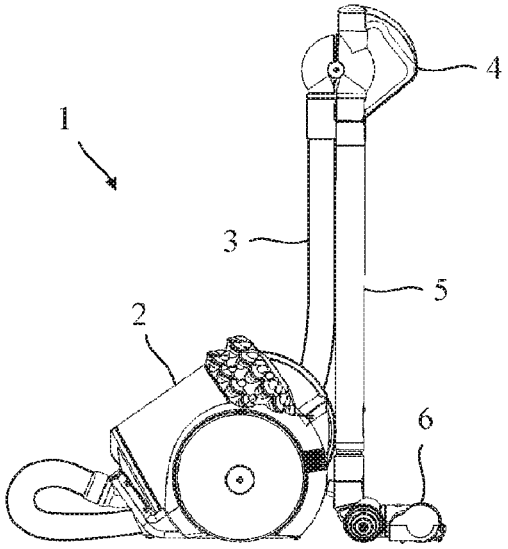
FIG. 11 shows the vacuum cleaner of FIG. 1 in a storage position.

In addition to providing benefits when the vacuum cleaner 1 is in use, the handle assembly 4 also provides benefits when the vacuum cleaner 1 is not in use. As illustrated in FIG. 11, when storing the vacuum cleaner 1, the elongate tube 5 or cleaner head 6 may be docked to the main body 2 in a manner that causes the elongate tube 5 to extend vertically upwards. With a conventional handle assembly, the hose would then extend upwardly and outwardly away from the handle assembly, before looping back to the main body. As a result, the vacuum cleaner would be relatively unstable and may easily be knocked by a user colliding with the hose. Additionally, the vacuum cleaner would require a relatively large storage space. With the handle assembly 4 described herein, the first duct 12 is free to pivot relative to the second duct 13 such that the hose extends vertically downwards from the handle assembly 4. As a result, the center of gravity of the vacuum cleaner 1 is lower, thus making the vacuum cleaner 1 more stable. Additionally, the vacuum cleaner 1 is more compact and requires less storage space.

Figure 12:
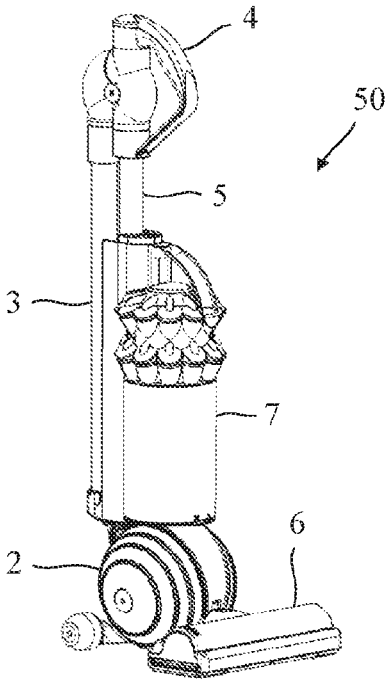
FIG. 12 shows a further vacuum cleaner comprising the handle assembly in accordance with the present invention.

The handle assembly 4 has thus far been described as forming part of a canister vacuum cleaner 1. Equally, however, the handle assembly 4 may form part of an alternative type of vacuum cleaner. By way of example only, FIG. 12 illustrates an upright vacuum cleaner 50 comprising the handle assembly 4. As with the canister vacuum cleaner 1 of FIG. 1, the upright vacuum cleaner 50 comprises a main body 2, a hose 3, a handle assembly 4, an elongate tube 5, and a cleaner head 6. However, unlike the canister vacuum cleaner 1, the elongate tube 5 and the cleaner head 6 of the upright vacuum cleaner 50 are each directly attached to the main body 2. The vacuum cleaner 50 has two modes of cleaning: floor and above-floor. In floor cleaning mode, the elongate tube 5 is locked to the main body 2 and is prevented from rotating relative to the main body 2. The handle assembly 4 is then used to maneuver the vacuum cleaner 50 as a whole over the cleaning surface. In above-floor cleaning mode, the elongate tube 5 is unlocked and detached from the main body 2. A valve or other means within the main body 2 redirects the suction generated by the vacuum motor (not shown) from the cleaner head 6 to the elongate tube 5. The handle assembly 4 and elongate tube 5 may then be used to clean surfaces above the floor, perhaps with the aid of an accessory tool attached to the elongate tube 5. When the vacuum cleaner 1 is returned to floor cleaning mode and the elongate tube 5 is attached to the main body 2, the first duct 12 pivots under the weight of the hose 3 such that the hose 3 hangs vertically downwards. As a result, the handle assembly 4 and the hose 3 adopt a relatively compact arrangement. Additionally, the hose 3 is not subject to any bending stresses at the attachment with the handle assembly 4.

The invention claimed is:

1. A handle assembly for a vacuum cleaner, the handle assembly comprising:

a handle attached to a duct assembly, wherein the duct assembly comprises a first duct and a second duct, the first duct pivots relative to the second duct about a pivot axis, the first duct and the second duct rotate collectively relative to the handle about a rotation axis, and the rotation axis is orthogonal to the pivot axis.

2. The handle assembly of claim 1, wherein the duct assembly comprises a third duct, the handle is fixedly attached to the third duct, and the second duct is rotatably attached to the third duct.

3. The handle assembly of claim 1, wherein the handle is rotatably attached to the second duct for rotation about the rotation axis.

4. The handle assembly of claim 1, wherein the first duct pivots relative to the second duct though an angle of at least 90 degrees.

5. The handle assembly of claim 1, wherein the first duct and the second duct rotate relative to the handle through an angle of at least 90 degrees.

6. The handle assembly of claim 1, wherein the first duct and the second duct each comprise an arcuate section that arcs about the pivot axis, and pivoting the first duct relative to the second duct causes the arcuate section of one of the ducts to move in and out of the arcuate section of the other of the ducts.

7. The handle assembly of claim 1, wherein the duct assembly has a first end that extends along a first axis and a second opposite end that extends along a second axis, and the first duct is free to pivot to a position in which the first axis is parallel to the second axis.

8. The handle assembly of claim 1, wherein the pivot axis is located below the handle, and the second duct arcs upwardly into the space between the handle and the pivot axis.

9. The handle assembly of claim 1, wherein the second duct is a double-walled duct comprising an inner tube and an outer tube, and pivoting the first duct relative to the second duct causes the first duct to move between the inner tube and the outer tube.

10. The handle assembly of claim 1, wherein one end of the duct assembly is attachable to a hose, and the other end of the duct assembly is attachable to an attachment comprising one of an elongate tube, a cleaner head and an accessory tool.

11. A vacuum cleaner comprising;

a hose and a handle assembly, the handle assembly comprising:

a handle attached to a duct assembly, wherein the duct assembly comprises a first duct and a second duct, the first duct pivots relative to the second duct about a pivot axis, the first duct and the second duct rotate collectively relative to the handle about a rotation axis, and the rotation axis is orthogonal to the pivot axis wherein the hose is attached to one end of the duct assembly and moves relative to the handle as the first duct pivots relative to the second duct and as the first duct and the second duct rotate collectively relative to the handle.

12. The vacuum cleaner of claim 11, wherein the vacuum cleaner comprises an attachment attached to the opposite end of the duct assembly, the attachment comprising one of an elongate tube, a cleaner head and an accessory tool.

13. A handle assembly for a vacuum cleaner, the handle assembly comprising:

a handle attached to a duct assembly, wherein the duct assembly comprises a first duct and a second duct, the first duct pivots relative to the second duct though an angle of at least 90 degrees, and the first duct and the second duct rotate collectively relative to the handle through an angle of at least 90 degrees.

14. The handle assembly of claim 13, wherein the first duct pivots relative to the second duct about a pivot axis, the first duct and the second duct each comprise an arcuate section that arcs about the pivot axis, and pivoting the first duct relative to the second duct causes the arcuate section of one of the ducts to move in and out of the arcuate section of the other of the ducts.

15. The handle assembly of claim 13, wherein the first duct pivots relative to the second duct about a pivot axis, the first duct and the second duct rotate collectively relative to the handle about a rotation axis, and the rotation axis is orthogonal to the pivot axis.

16. The handle assembly of claim 13, wherein the duct assembly comprises a third duct, the handle is fixedly attached to the third duct, and the second duct is rotatably attached to the third duct.

17. A handle assembly for a vacuum cleaner, the handle assembly comprising:

a handle attached to a duct assembly, wherein the duct assembly comprises a first duct and a second duct, the first duct pivots relative to the second duct about a pivot axis, the first duct and the second duct rotate collectively relative to the handle about a rotation axis, the first duct and the second duct each comprise an arcuate section that arcs about the pivot axis, and pivoting the first duct relative to the second duct causes the arcuate section of one of the ducts to move in and out of the arcuate section of the other of the ducts.

18. The handle assembly of claim 17, wherein the rotation axis is orthogonal to the pivot axis.

19. The handle assembly of claim 17, wherein the duct assembly comprises a third duct, the handle is fixedly attached to the third duct, and the second duct is rotatably attached to the third duct.

20. The handle assembly of claim 19, wherein the handle is fixedly attached at one end to the third duct and is rotatably attached at an opposite end to the second duct.

* * * * *